United States Patent [19]

Schwartzman

[11] Patent Number: 4,882,993

[45] Date of Patent: Nov. 28, 1989

[54] ELECTRONIC BACK-UP SAFETY MECHANISM FOR HAND-EMPLACED LAND MINES

[75] Inventor: Alvin Schwartzman, Kinnelon, N.J.

[73] Assignee: The United States of America as represented by the Secretary of the Army, Washington, D.C.

[21] Appl. No.: 229,514

[22] Filed: Aug. 5, 1988

[51] Int. Cl.[4] ..... F42C 11/00

[52] U.S. Cl. ..... 102/218

[58] Field of Search ..... 102/218, 206

[56] References Cited

U.S. PATENT DOCUMENTS

| | | | |
|---|---|---|---|
| 3,340,811 | 9/1967 | Gauld | 102/218 |
| 4,001,610 | 1/1977 | Griffin | 102/218 |
| 4,617,866 | 10/1986 | Simpson | 102/206 |
| 4,632,032 | 12/1986 | Muller | 102/218 |
| 4,699,241 | 10/1987 | Kerekes | 102/218 |
| 4,712,477 | 12/1987 | Aikon et al. | 102/206 |
| 4,776,277 | 10/1988 | Fieldler et al. | 102/206 |

FOREIGN PATENT DOCUMENTS

| | | | |
|---|---|---|---|
| 8835 | 3/1980 | European Pat. Off. | 102/218 |
| 1955025 | 8/1971 | Fed. Rep. of Germany | 102/218 |
| 2750972 | 5/1979 | Fed. Rep. of Germany | 102/206 |
| 3021976 | 12/1981 | Fed. Rep. of Germany | 102/218 |
| 890146 | 2/1962 | United Kingdom | 102/218 |
| 2160954 | 1/1986 | United Kingdom | 102/206 |

*Primary Examiner*—Deborah L. Kyle
*Assistant Examiner*—Stephen Johnson
*Attorney, Agent, or Firm*—Robert P. Gibson; Edward Goldberg; Michael C. Sachs

[57] ABSTRACT

A back-up electrical safety device for a land mine is presented which provides an additional 50 to 60 second time delay concurrent with the conventional built-in one minute delay before any detonation is possible. A soldier is therefore afforded an additional assurance of an ear one minute time lag before an accidental explosion could be possible due to premature pulsing of the mines's built-in timer. A Darlington pair RC switching circuit appears electrically in tandem between the internal timer and the various arming means, to doubly insure an approximate one minute override before detonation. This dual safety feature permits hand-emplacement, over gun-launching, of a conventional land mine.

1 Claim, 3 Drawing Sheets

ELECTRONIC BACK-UP SAFETY MECHANISM FOR HAND-EMPLACED LAND MINES

GOVERNMENTAL INTEREST

The invention described herein may be made, used, or licensed by the Government of Governmental purposes, without the payment to me of any royalties thereon.

BACKGROUND AND FIELD OF THE INVENTION

This invention relates to the field of munitions in general, and to hand emplaced mines in particular. One munition in particular, designated ADAM, is a gun-launched mine which is meant to lie on the ground's surface when deployed. The mine is then denoted when an enemy comes in close contact with it, by pulling a trip line which lines extend in several directions from the mine. (The lines are gas-propelled to extend out after the mine lands on the ground). There are multiple safeties in the mine to prevent premature and/or unwanted explosions. For example, the mine only commences arming and battery activation while in flight. Mechanical means through a safing and arming (S & A) device sense both spin and set back forces on the mine which puts the explosives in line and also permits a main timer to begin an arming sequence of the mine detonator. The presence of the both these conditions of course, could only be done in the special environmental conditions of gun launch, when there is present both setback of the mine, and also spin of the mine in the launch tube. In addition to these safeties, there are also electrical means which combine to provide an at least 60 second time delay, from time of (battery) power activation, the possibility of initial detonation. A primary timer circuit within the mine, as mentioned earlier, through a firing capacitor generates the 3.0–3.5 volts pulse needed to activate detonation only after a time delay of some 60 seconds. This acts to provide a 60 second delay as above mentioned. The S & A enables the explosive train and also the primary timer circuit generates the approximate 3.0 volt pulse to activate the gas generation means for expelling the various trip lines which provide the detonation drive means. As a further safety to prevent arming before these mines are emplaced into use, the firing circuit electrical output from the said primary timer circuit is shunted with a near dead-short while in the gun. The shunting bar used permits less than 0.5 volts potential to ever exist across those output terminals (which are in parallel to the safing and arming mechanism's detonating input terminals). Since 0.5 volts cannot be enough to ever activate the safing and arming means to detonate the mine, the shunting bar could therefore be considered as a closed switch (until cut open at launch) whereupon it becomes an open circuit. In addition, a battery aboard the mine is also not engaged to power the mine until launch whereupon a mechanical means causes the battery to be engaged to activate the mine's circuitry when a ball is pushed in upon the mine's exiting from the projectile. Also, the shunt bar (which is physically an approximately ½" strip of sheet brass), is physically cut or ripped apart, as the mine exits from the projectile through contact with a tool for this purpose which engages it while the mine passes through. The timing circuit, activated by the battery, now stands ready to generate its 3.0–3.5 volt pulse at the end of 60 seconds time, and there is no longer a shunt bar to dead-short this pulse when it does get generated, for it has been cut. Of course, upon beginning flight and coming to rest on the ground, the primary timer circuit expels a plurality of tripwires which can be tripped when contacted. The mine is now fully activated and ready to be tripped by an approaching enemy. One can see the many safety features in this mine which only enable it to be armed by being properly launched from the gun, and not through an accident. After landing, the mine awaits detonation when stepped on or about, and tripped by the pursuer. It is known that after another pre-selected longer length of time, the mines then also automatically detonated. This is done so that the field will again be clear to friendly soldiers after a certain length of time, without mine clearing.

It is now proposed that the ADAM mine be simply dropped by hand, rather than launched out of a gun. The soldiers could simply drop the mines, to engage an enemy which is pursuit of them. The mines would become armed shortly thereafter and therefore later explode when stepped on by the pursuing enemy or when the enemy comes into close contact therewith during pursuit, but never before a 60 seconds' time duration, on account of the timer circuit earlier described. This time delay of course is comfortable and a necessary safety for the friendly soldiers, since otherwise the mine might go off unexpectedly even upon being hand-emplaced by the friendly soldier. The 60 seconds is not, on the other hand, difficult to live with. It is compatible with typical pursuit times, and is in effect better than a hand grenade which actually has too short a detonation time for such pursuit situations. The now to be hand-emplaced variation of the ADAM mine has of course several mechanical modifications over the original gun-launched type mine design. Instead of the battery being activated upon launch from a gun by automatic mechanical pushing in of a ball, now the ball is plunged in by the soldier forcibly closing a heavy bar. There is no more sensing for spin or set-back forces, since this is no longer in a gun-launched environment, and significantly, there is still a shunting bar for removal in this design (done by the same action as activating the battery). One can see now, that except for the select battery activation and the 60 second time delay caused by the primary timer-circuit, there are now no more safety features in the mine. If the primary timing circuit malfunctions with a premature pulse, there is nothing to save the friendly soldier from an immediate detonation. The cutting of the shorting bar upon launch approach is used, say by being cut when the soldier draws the heavy bar to activate the battery. The cutting actually adds nothing in the way of safety, since the soldier is directly proximate the mine (unlike in the gun-launched situation where when the bar is cut there is a safe separation distance from the gun/soldier), and there is nothing but the timing circuit to prevent the mine from going off. As explained before, an at least double safety to the timing circuit is necessary, and now sought to be devised, therefore.

It is of course far less important if the mine fails to detonate, as in a dud, than if it accidentally explodes when a soldier is holding same. In fact it is a design goal to have less than one device per 100,000 as unfortunately defective in terms of premature explosion. This premature explosion caused by the failure of both the primary timer-circuit, and also of a back-up safety mechanism as to be proposed by this invention will become much more remote because of the joint probability of failure of two mechanisms at the same time.

BRIEF DESCRIPTION OF THE INVENTION

In solution to this problem, the inventor has devised a second independent timing circuit to be placed in tandem to the said main timing circuit, to replace the old shunting bar arrangement. This new component functions as a double safety; it is arranged to function as a closed circuit to short main timer firing circuit until at least the 60 seconds time duration desired. It is further devised to also not draw needless current or get into a "race problem" with the other components. Much attention must be given to match this new circuit in both directions, as it fits conceptually in between the old timing circuit and the S & A, and of course must be electronically compatible with both these components. A modified Darlington-type amplifier circuit was selected for this purpose, largely to add an additional 60 second time delay needed before the mine can be armed, as will be discussed in greater detail hereinafter. In reality, the main timer, back-up timer, and S & A are integrated and packaged together, rather than being purely discrete elements.

OBJECTS OF THE INVENTION

Accordingly, it is an object of this invention to provide a substitute dual safety means for an ADAM land mine when used in hand-emplaced, versus gun-launched, applications.

Another object of this invention is to provide backup safety means as can be used in munitions in general for adding a further, necessary time delay before any detonation is possible to occur, thus preventing accidental detonations when a primary timing system malfunctions.

Other objects and advantages will become obvious to those skilled in the art from a reading of the within specification and a viewing of the drawings, in which:

DETAILED DESCRIPTION OF THE INVENTION

Figure 1:
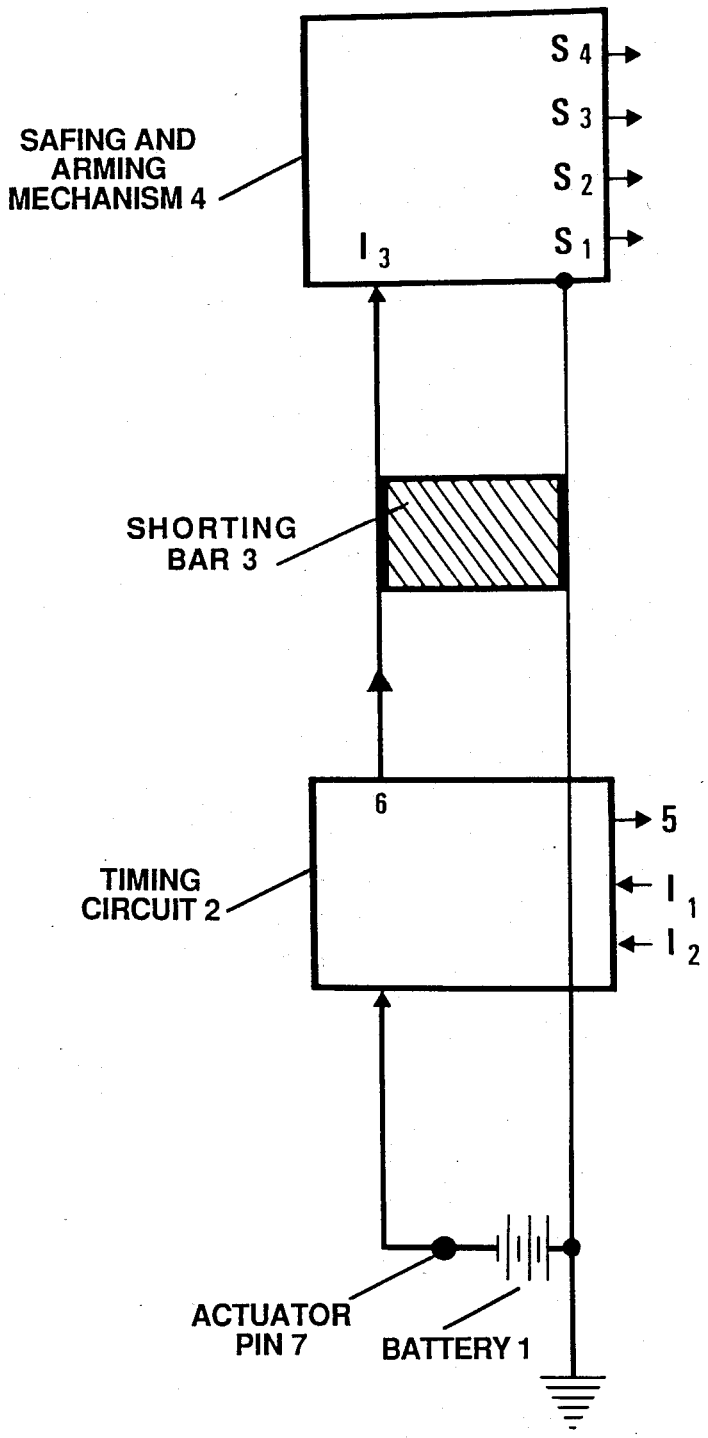
FIG. 1 (PRIOR ART)
FIG. 1 shows conceptually the timer circuit, shorting bar, and safing and arming arrangement in the ADAM land mine system.

FIG. 1 illustrates conceptually, two portions of the electronics subsystems of the ADAM gun-launched mine system. While timing circuit 2, and safing and arming mechanism 4 are shown oversimplified as two separate components in tandem, yet in reality these parts are integrated together for circuit and packaging reasons. Shorting bar 3, as mentioned earlier, limits the output of the timing circuit to under 0.5 volts and effectively is a closed circuit until cut during launch. The main electronics assembly produces (actually internally) two output signals shown at 5 and 6 respectively to feed gas generator means to expel the bridgewires mentioned above and also to arm a detonation means. As mentioned earlier, a time delay mechanism of this invention (FIG. 2), will replace the function of the shorting bar 3 of the ADAM, when the mine is converted for use as a hand-emplaced PDM (pursuit deterent munition) as shown in FIG. 3. (Signals marked $I_1$–$I_3$ and $S_1$–$S_4$ represent certain interconnections between the mine's elements, not needed to be here explained, for the focused discussion here on this particular invention, but are shown to indicate the existence).

Figure 2:
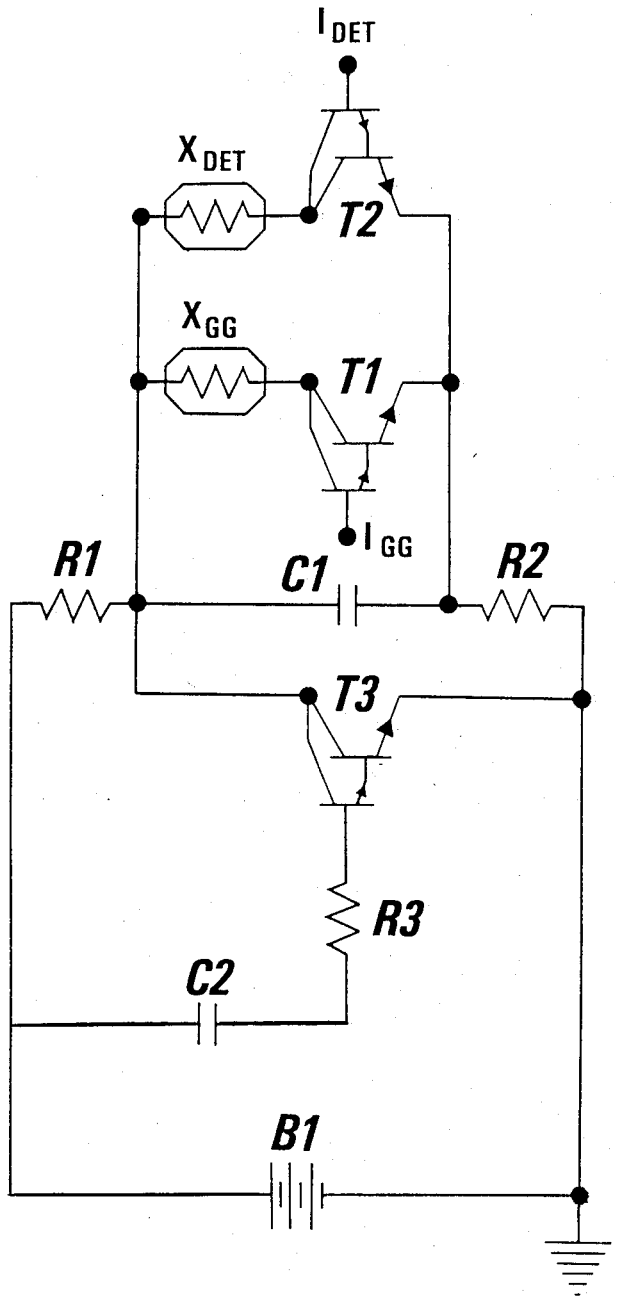
FIG. 2 shows Applicant's Darlington time delay safety circuit, used in place of the shorting bar in FIG. 1 for hand-emplaced land mine arrangements.
Figure 3:
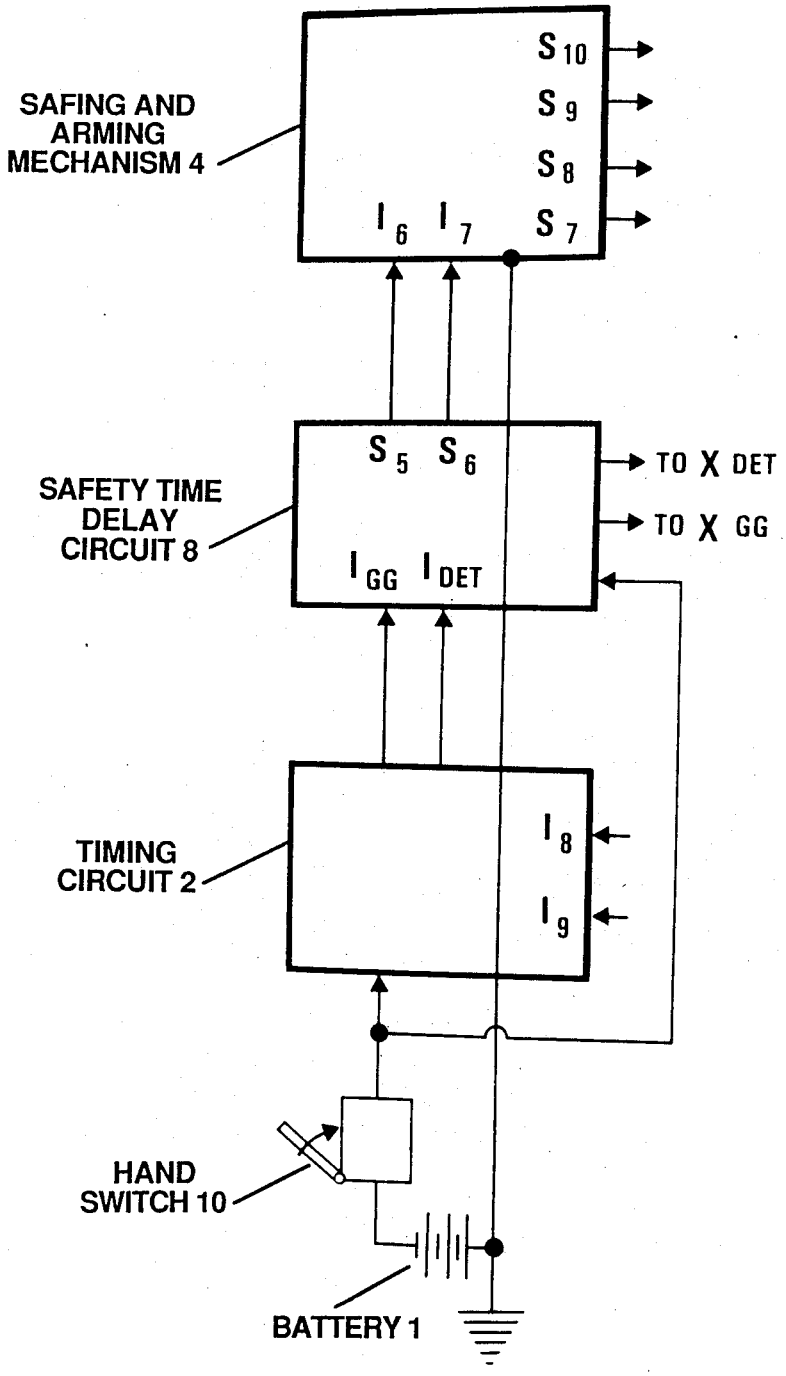
FIG. 3 shows schematically the hand-emplaced adaption of the ADAM mine system of FIG. 1.

In FIG. 2, there is shown the safety timing mechanism of this invention for use in place of the ADAM's shorting bar. The new circuit offers increased safety by in effect shorting a Firing Capacitor C1. The proposed electronic safety circuit comprises components C2, R3, and T3. Current limiting resistors R1 and R2 operate to set an RC time constant of approximately 10 seconds. Upon battery (B1) power-up condition, capacitor C2 begins to charge through R3 and the base-emitter junction of transistor T3. This current will then be set to charge C2 to a potential of Vb-Vbe at 50 seconds, after which transistor T3 will turn off allowing capacitor C1 to charge. Should either the Gas Generator or the Detonator firing transistor-pairs (T1 or T2 respectively) conduct during this initial 50 second window, jthe voltage on the fire capacitor C1 will nonetheless be insufficient of that amount necessary to fire the explosive bridgewires. When transistor pair T3 is on, C1 will charge to the Vce voltage, which is equal to the Vce drop on either of the fire transitors should they prematurely conduct. Neither the gas generator activation circuit XGG which traces through pair T1 nor the detonator activating circuit X DET which traces through pair T2, can be activated until the T1 or T2 pair, respectively, are adequately biased so as to be able to conduct; this can only happen when firing capacitor C1 is fully charged which as mentioned earlier only occurs after the 50 odd seconds of (R3×C2) charge time. When adequately biased, then the gas generator activation signal I GG (which comes from the general timer circuit) as well as the detonator activation signal I DET are allowed to pass through their respective T1 or T2 gating means, so as to power the further X GG or X DET activation circuit means. In such a manner, the circuit of FIG. 2 provides a dual safety, adding a 50–60 second time period before any explosion can be initiated. Battery B1 can be the same as element 1 when the components are all integrated together. FIG. 3 shows schematically the hand-emplaced version of the ADAM mine of FIG. 1. Battery actuator pin 7 has been replaced here by spring hand bar 10 which is closed by the soldier to activate the mine. This gives him 60 seconds before the mine becomes active, to presumably leave the area. The closing of bar switch 10 activates both the main timer and also the 60 second back-up timer which acts to short out the main timer signals unless 60 seconds have gone by. This assures the soldier that if the main timer malfunctions and pulses before the 60 seconds, then at least such signals can not cause any detonation until the back-up timer permits same, which in any event would take 60 seconds as well. (Signals designated $S_5$–$S_{10}$ and $I_6$–$I_8$, meant to illustrate some interconnections amongst the mine's elements, being not a part of the main invention, will not be explained further at this time. The existence of such other connections however, is thus shown.)

It may be seen from the above that a mechanism has been presented which will prevent the mine from firing during the first 60 second window interval, even if the general mine timing circuit should accidentally produce the necessary 3.0 Volts or larger pulse, during the 60 second window period.

While the invention may have been described with reference to one particular embodiment or embodiments, the invention is considered to also include all variations, substitutions and modifications thereof as will occur to those skilled in the art to be within the spirit and scope of the invention describe. For example, use of the circuit need not even be limited to munitions but to any such timing-switching circuit environments where its function could be useful.

What is claimed is:

1. A munition device having means for insuring expiration of a predetermined time delay until arming of said munition, including circuit means which comprises:

a first N-P-N Darlington transistor pair (T3) with grounded emitter; an input series resistor-capacitor (R3-C2) timing delay circuit in series with an input to the base of said first transistor pair; an output from the collector side of said first transistor pair connected to a firing capacitor C1, said C1 capacitor connected to ground through a first bias resistor R2 and negatively biased from a battery (B1) through a second bias resistor R1; and second N-P-N Darlington transistor pair (T2) in parallel to said firing capacitor C1 feeding a detonator through the collector path of said second transistor pair, and; a third N-P-N Darlington transistor pair (T1) also in parallel with said firing capacitor C1, feeding Gas Generator Means through the collector path of said third transistor pair, said second and third transistor pairs (T1 and T2) receiving respective Gas Generator Means and detonator inputs from a timer logic included in said munition device.

* * * * *